United States Patent [19]

Steiner

[11] Patent Number: 4,773,352

[45] Date of Patent: Sep. 27, 1988

[54] APPLICATOR FOR AN ADHESIVE MATERIAL

[75] Inventor: Erich Steiner, Brannenburg, Fed. Rep. of Germany

[73] Assignee: Planatolwerk Willy Hesselmann, Chemische und Maschinenfabrik fur Klebetechnik GmbH & Co. KG, Rohrdorf-Thansau, Fed. Rep. of Germany

[21] Appl. No.: 888,143

[22] Filed: Jul. 18, 1986

[30] Foreign Application Priority Data

Jul. 19, 1985 [DE] Fed. Rep. of Germany ..... 3525805

[51] Int. Cl.[4] ..... B05C 5/02

[52] U.S. Cl. ..... 118/411; 118/419

[58] Field of Search ..... 118/410, 411, 259, 419

[56] References Cited

U.S. PATENT DOCUMENTS

| | | | |
|---|---|---|---|
| 4,048,950 | 9/1977 | Rakowicz et al. | 118/411 X |
| 4,502,912 | 3/1985 | Steiner | 118/411 X |
| 4,638,757 | 1/1987 | Sandgren | 118/411 |

*Primary Examiner*—John P. McIntosh
*Attorney, Agent, or Firm*—Herbert Dubno

[57] ABSTRACT

For a very rapidly running press, in which webs are attached together by application of a series of linear transverse portions of glue instead of clipping them together, the known adhesive applicator technology when a different spacing is desired between the portions of glue or adhesive applied to the sheet, require change-over of the entire apparatus. With the present invention there is a division of the adhesive application operation between two different groups of components of which one group is a part of an operating machine while the second group is mutually interchangeable with other members of the group having a different size. The first group of components includes a shaft for the applicator cylinder with its drive, its bearing, a control means and a central body nonrotatably attached to the shaft. The second group of components comprises at least one cylinder body forming the outer circumference of the applicator cylinder which is rigidly attached to either the shaft or the central body mounted on the shaft. An insert containing a series of outlet holes for the adhesive material and an adhesive material feed duct is mounted in at least one guide in the cylinder body or bodies and can be used in a plurality of different sized interchangeable cylinder bodies and hence applicator cylinders.

9 Claims, 4 Drawing Sheets

APPLICATOR FOR AN ADHESIVE MATERIAL

FIELD OF THE INVENTION

My present invention relates to an applicator for an adhesive material and more particularly, to an applicator for applying a plurality of transverse adhesive zones to a web in order to attach together two rapidly moving webs or sheets.

BACKGROUND OF THE INVENTION

Glue can be applied to a rapidly moving web, e.g. in a high-speed printing press using an applicator cylinder or drum in which a substantial region of the outer surface of an applicator cylinder driven rotatably about its rotation axis is contacted by the web to which adhesive is to be applied and the corresponding areas of that outer surface are dimensioned according to the spacing of the transverse adhesive portions or lines to be applied to the web.

The adhesive material from a fixed axial supply duct is conducted to an adhesive glue feed duct rotating with the applicator cylinder which extends to a line on the outer surface of the applicator cylinder along which a plurality of outlet openings in the applicator cylinder are provided for the adhesive or glue.

An adhesive application operation with these features is taught in German Pat. No. 32 22 335. The portions of adhesive are applied to a very rapidly running paper or fabric web with rotating applicator cylinder on whose periphery along a line on the outer surface there is an array of outlet openings for the adhesive. The adhesive material is delivered pointwise through these openings. The transverse line of adhesive on the web thus is now of glue spots at these points.

On account of the high speed of the web to which adhesive is to be applied the applicator cylinder necessarily has a high rotational speed. This leads to problems in the discharge of adhesive material from the outlet openings. In order to prevent centrifugal force from discharging glue improperly, the outlet openings are closed from the inside when these outlet openings are not covered by the web to which adhesive is to be applied.

On the other hand, the web is fed with a comparatively large contact angle around the applicator cylinder. Where the web contacts the applicator cylinder the outlet openings are opened from the interior so that the adhesive material can be conducted to the web under the influence of centrifugal force. When the applicator cylinder and apparatus is at rest sealing rollers press against the outlet openings from the outside of the applicator cylinder.

The applicator of German Pat. No. 32 22 335 has achieved widespread acceptance in the printing industry. Particularly in gavure printing. However problems arise which are associated with the different lengths of the printed page. The printing machine is usually formed so that the entire printing cylinder can be interchangeable with another of a different diameter so that the machine can print the web with pages of different length.

The applicator cylinder for the adhesive must have a completely defined diameter and the required spacing of the portions of adhesive on the web is constant. However, should the need arise for a size change in the gravure machine not only must the gravure printing cylinder be changed, but the entire glue applicator cylinder must be correspondingly replaced. The same problem occurs also with other machines in which the spacing of the transverse adhesive portions must be changeable.

OBJECTS OF THE INVENTION

It is an object of my invention to provide an improved applicator for an adhesive material, particularly for application of a plurality of transverse adhesive portions to a web for attaching together two rapidly moving sheets which obviates the drawbacks of the prior art.

It is also an object of my invention to provide an improved applicator for an adhesive to a web in which the spacing between a plurality of transverse adhesive portions applied to the web can be varied without changing the entire apparatus.

SUMMARY OF THE INVENTION

These objects and others which will become more readily apparent hereinafter are attained in an apparatus for application of an adhesive material to a web or the like comprising a rotating press in which a substantial region of the outer surface of an applicator cylinder driven rotatably about its rotation axis is contacted by the web to which adhesive is to be applied.

The outer surface is dimensioned according to the spacing of the transverse adhesive portions to be applied to the web.

The adhesive material from a fixed axial supply duct is conducted to an adhesive material feed duct rotating with the applicator cylinder which extends to a line on the outer surface of the applicator cylinder on which a plurality of outlet openings in the applicator cylinder are provided for the adhesive material.

According to my invention the applicator cylinder is subdivided structurally in such a way that a shaft having a drive and bearings in the machine for the apparatus is attached interchangeably but nonrotatably to at least one interchangeable cylinder body of a selectable diameter forming the outer circumference of the applicator cylinder and at least one of the cylinder body is formed with at least one guide which receives an insert having the adhesive material duct and the outlet openings therein.

The shaft of the applicator cylinder with its drive, bearings and control means which are a part of an external operating machine remain in place during a change in the size of the applicator cylinder but the cylinder bodies forming the outer circumference of the applicator cylinder are changed and the inserts are transferred to the replacement cylinder bodies.

Thus, the capital cost for the adhesive applicator is substantially reduced. In particular it is possible to glue together press products of different page sizes made in a gravure process instead of stapling them together.

However, my invention is not limited to a gravure printing process.

More specifically, the shaft and the cylinder bodies forming the outer circumference of the applicator cylinder are simple in structure and nonrotatably attached together so that at high rotational speeds no negative effects occur.

In one embodiment of my invention, a central body is nonrotatably attached to the shaft of the applicator cylinder and has a prismatic, especially a rectangular, cross section. Two or more cylinder bodies may be used and these cylinder bodies forming the outer circumference of the applicator cylinder may be screwed on the central body from different directions.

Each of the cylinder bodies forming the outer circumference of the applicator cylinder is advantageously a cylinder half shell with a prismatic central interior and at least one of the cylinder half shells has a guide for receiving an insert. Both of these cylinder half shells are clamped against each other by screws penetrating the shaft and the central body, are screwed directly together at their periphery and at a right angle to the central body.

Alternatively, in another embodiment of my invention a single cylinder body substantially forming the outer circumference of the applicator cylinder has a radial recess corresponding to the diameter of the shaft and is attached nonrotatably to the shaft with the help of a clamping piece fitting into the recess. In either case, the body or bodies can be removed without dismounting the shaft and its bearings and/or drive.

Advantageously, the adhesive material feed duct present in the insert in the applicator cylinder is connected to an axial supply duct in the shaft by a connecting tube extending along an end surface of the applicator cylinder.

My invention allows one insert to be used for several different sized applicator cylinders. The curvature of the outer surface of the insert is chosen to correspond to the curvature of the smallest applicator cylinder of the group.

When such an insert is used in an applicator cylinder whose diameter is greater than the cylinder corresponding to the outer curvature of the insert (that is, in an applicator cylinder whose outer surface curvature is less than that of the insert), then a step or discontinuity in the outer surface of the applicator cylinder results at the edge of the guide as a result of the different curvatures of the insert and the applicator cylinder. It is essential only that the position of the outlet opening on the insert outer surface coincide with the imaginary continuation of the outer surface of the applicator cylinder so that a paper or similar web in contact with the applicator cylinder experiences no impact forces due to the insert.

The utility of the insert is broadened when the insert has a discontinuous or step shape at each of its longitudinal ends and in the individual step regions formed a filler member is inserted. The latter member can have a curvature matching the curvature of the outer surface of the applicator cylinder.

In another embodiment of my invention the insert containing the adhesive material feed duct can have a rear set back contacting surface having the outlet holes therein against which a covering member covering the insert is clamped whose outer surface has a curvature corresponding to the curvature of the applicator cylinder and a continuation of each of the outlet openings of the insert extending to the outer surface of the covering member. The continuations of the outlet openings can have an larger diameter on the inner side of the covering member than the outer side and are each dimensioned to receive a stopper for closure thereof.

So that adhesive material does not issue from the outlet openings when the applicator cylinder is at rest a sealing roller mounted on an upright leg of a movable bent lever is provided which is positionable so as to seal the outlet openings of the applicator cylinders of different diameters. When two inserts are provided in a single applicator cylinder two bent levers are provided each having sealing rollers for closing the outlet openings of the inserts and the bent-arm levers are connected to a common drive mechanism between the bent levers.

BRIEF DESCRIPTION OF THE DRAWING

The above and other objects, features and advantages of my invention will become more readily apparent from the following description reference being made to the accompanying highly diagrammatic drawing in which.

SPECIFIC DESCRIPTION

Figure 1:
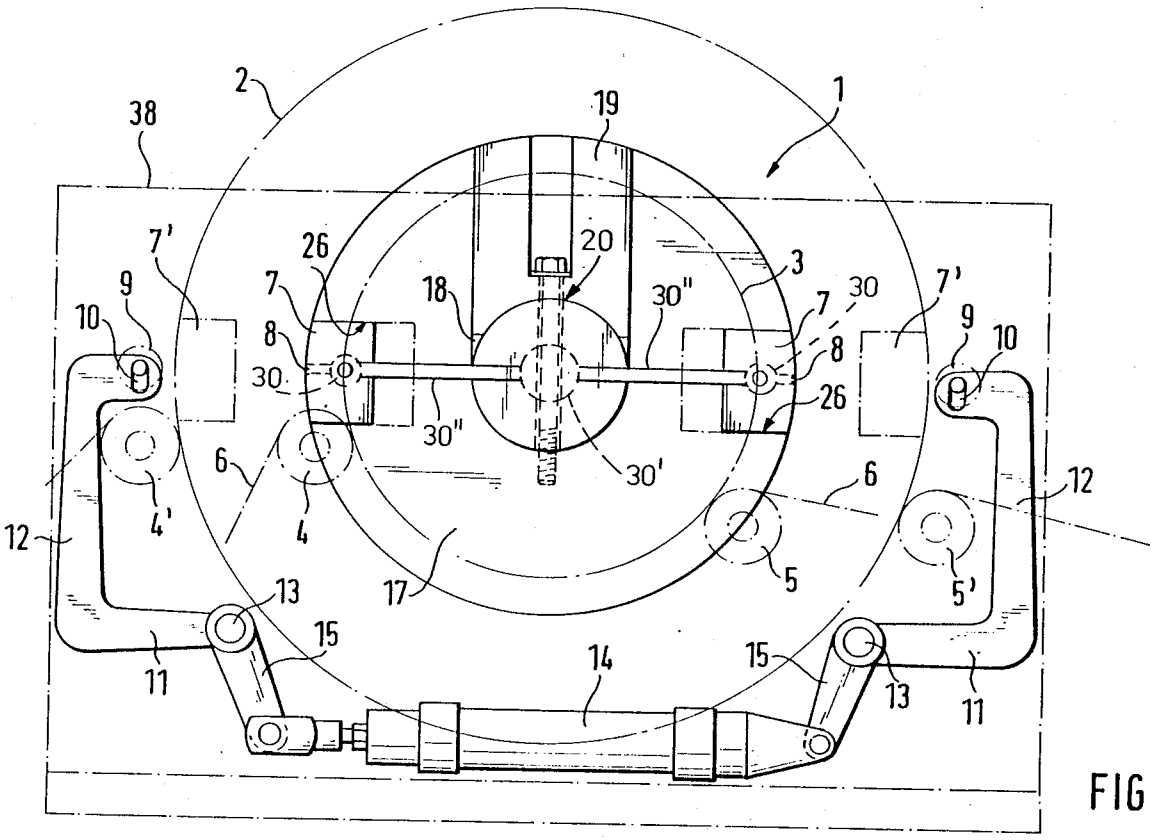
FIG. 1 is a front view of an applicator cylinder according to my invention and an arrangement for closing its outlet openings.

The embodiment of FIG. 1 comprises an applicator cylinder 1 together with guide rollers 4 and 5 for the web 6 to which adhesive portions are to be applied. In such a device applicator cylinders of various diameters may be required. In the embodiment of FIG. 1 the applicator cylinder with the smallest diameter is indicated with the reference character 3 while the one with the largest diameter is indicated with a 2.

The structure of the applicator cylinder 1, 2 or 3 in so far as it is not specially described below corresponds to the disclosure of German Pat. No. 32 22 335.

The basic principle of the invention is that a shaft 16 for the applicator cylinder 1, 2 or 3, its bearing B and controlling means or drive C (FIG. 3) is a part of an operating machine which rotates the shaft 16 about rotation axis 16' (FIG. 2) and that an interchangeable cylinder body 17 (FIG. 1) or bodies 22(FIG. 2) forming the circumference of the applicator cylinder can be rigidly nonrotatably attached to the shaft 16.

In the case of FIG. 1 it is possible to interchange the different diameter applicator cylinders 1, 2 or 3 since each cylinder body 17 essentially determining the cylinder circumference has a radial recess 18 whose width corresponds to the diameter of the shaft 16 is detachably mounted on the shaft 16. This cylinder body 17 is mounted with the help of a clamping piece 19 fitting into the radial recess 18 and a screw coupling 20 with the shaft 16. Only the clamping piece 19 need be loosened to be able to remove the cylinder body 17 from the shaft 16.

Figure 5:
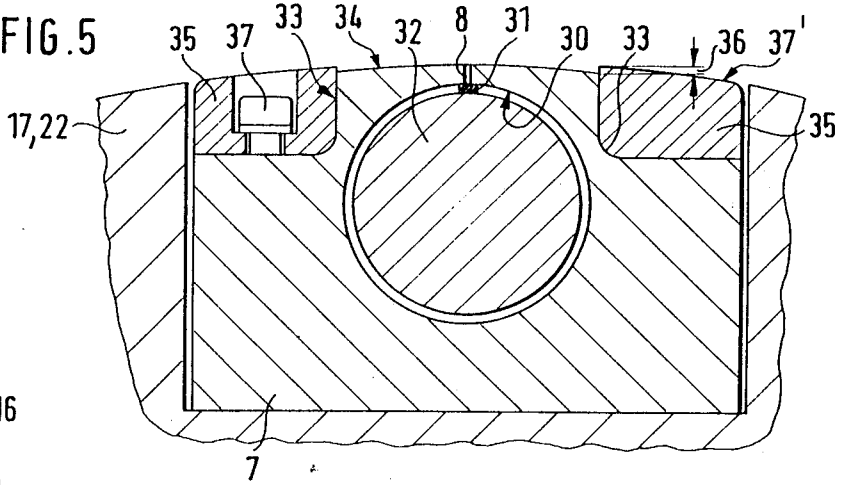
FIG. 5 is an enlarged cross sectional view through an insert with filler members.
Figure 7:
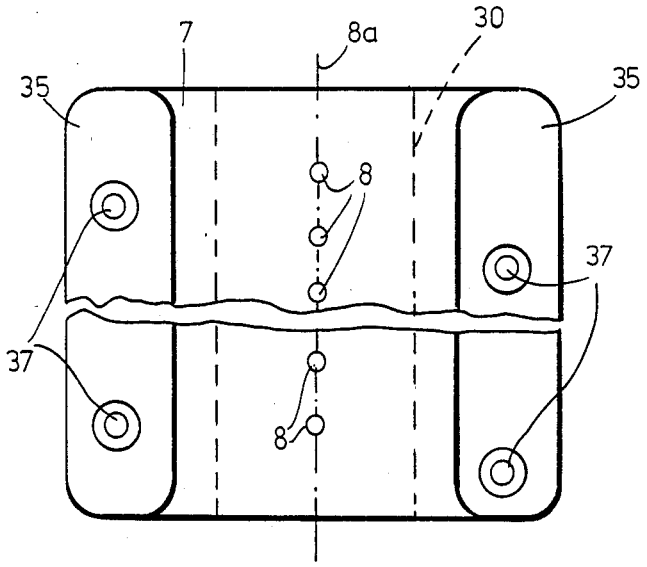
FIG. 7 is a top plan view of an insert for an applicator cylinder showing the row of outlet holes for the adhesive material portions.

In the cylindrical body 17 two guides 26 which each receive an insert 7 are provided in the embodiment of FIG. 1, which includes, as shown clearly in FIG. 5, an adhesive material feed duct 30 connected to at least one row of outlet openings 8 which extend along a line 8*a* on the covering surface of the applicator cylinder or insert 7 as shown in FIG. 7. Ihese outlet openings 8 are connected with the adhesive material feed duct 30. However they can be closed from the inside by a closing member 31. The adhesive material feed duct 30 adjacent to the front side of the individual inserts 7 is connected to an axial supply duct 30' in the shaft 16 by a connecting tube 30" mounted along the front surface of the applicator cylinder 1.

The web 6 is guided with the help of the guiding rollers 4 and 5 so that the web 6 contacts the applicator cylinder 1 to the greatest possible extent. Since applicator cylinders of different diameters 1, 2 or 3 are used, there is a need to be able to adjust the guiding rollers 4 and 5. The position of these guiding rollers when the applicator cylinder with the largest circumference 2 is used is indicated with dot-dash lines and the reference characters 4' and 5'.

The transverse adhesive application to the web 6 occurs, as described in German Pat. No. 32 22 335, so that the outlet openings 8 are opened from the inside as soon as the web 6 has covered those outlet openings 8 over the region of contact with web 6.

During the synchronized running of the web 6 and the applicator cylinder 1 inside of this covered region, the outlet openings 8 remain open. They are closed, however, just before the web 6 begins to lift from the circumference of the applicator cylinder 1. A linear transverse portion of adhesive on the paper web 6 results from the plurality of small diameter outlet openings 8 positioned side by side (FIG. 7). The web 6 with the adhesive is shortly thereafter brought together with another web to attach the two sheets together.

On stopping of the applicator cylinder 1, particularly during a pause in the work, the sealing rollers 9 are put against the outlet openings 8 in order to prevent drying of the adhesive material and closing of the outlet openings 8. The individual sealing roller 9 is supported on a bent lever 11, which is pivotable about the pivot axis 13.

The mount for the sealing roller 9 is provided on a upright leg 12 of the bent roller 11 which is constructed so that the guiding rollers 4 and 5 in their furthest separated position cannot prevent the motion of the bent lever 11. The position of the pivot axis 13 is thus so chosen that it is in the middle between both end positions of the sealing rollers 9 with respect to the smallest and the largest circumference applicator cylinders 3 and 2. As is apparent from FIG. 1 the axis of the sealing roller 9 describes a circular arc when the bent lever 11 is pivoted about the pivot axis 13 which has the relative effect of bringing the outlet opening 8 to the surface of the sealing roller 9. In order to attain an exact coverage of the outlet opening 8 an elongated hole 10 is provided in the bent lever 11 in which the sealng roller 9 is movable at opposite ends thereof.

When, as in the case of FIG. 1, two inserts 7 are used in each applicator cylinder 1 two bent levers 11 are accordingly provided which are suitably adjusted by a common drive mechanism 14 and by connecting bars 15.

My invention also includes a transverse adhesive applicator, in which only a single insert 7 is used in each applicator cylinder 1. In this case the twin device including the bent levers 11 and the sealing rollers 9 is retained. It is also possible to have more than two inserts 7 in the applicator cylinder 1. In this case the device including the bent levers 11 and the sealing rollers 9 must be correspondingly augmented.

Figure 2:
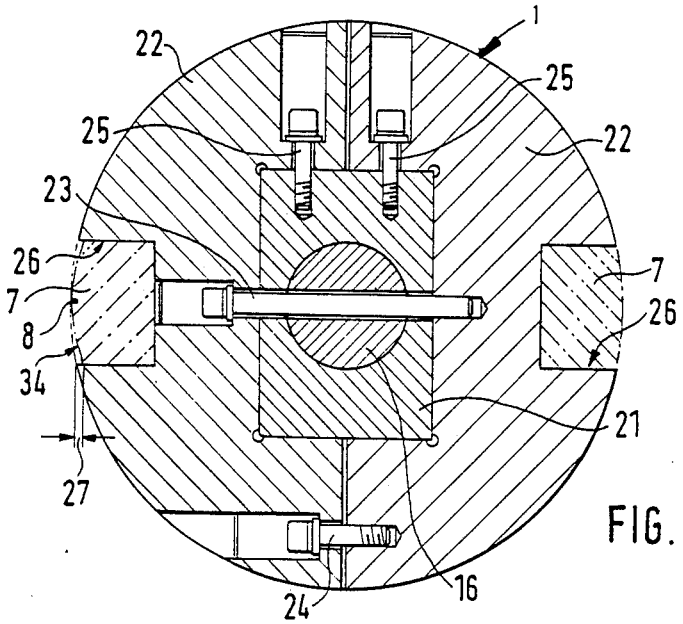
FIG. 2 is a cross sectional view through a cylinder according to my invention taken along the line II—II of FIG. 3.

In the embodiment according to FIG. 2 another structure for the applicator cylinder 1 is shown. In this case the shaft 16 has a central body 21 nonrotatably mounted thereon which remains rigidly attached to the shaft 16 when the applicator cylinders having different sizes are mounted on the shaft 16. The central body 21 can be screwed onto the shaft 16, welded, heat shrunk on it or attached in some other way so that relative rotation of shaft and body 21 is not possible.

Two cylinder half shells 22 are attached with the central body 21 which have the same prismatic interior surfaces fitting to the central body 21. Therefore such cylinder half shells 22 pairwise with different diameters can be mounted to provide applicator cylinders 1 with different diameters, but they must have identical central contacting surfaces so that the transverse adhesive portions are laid down with the desired spacing.

Figure 3:
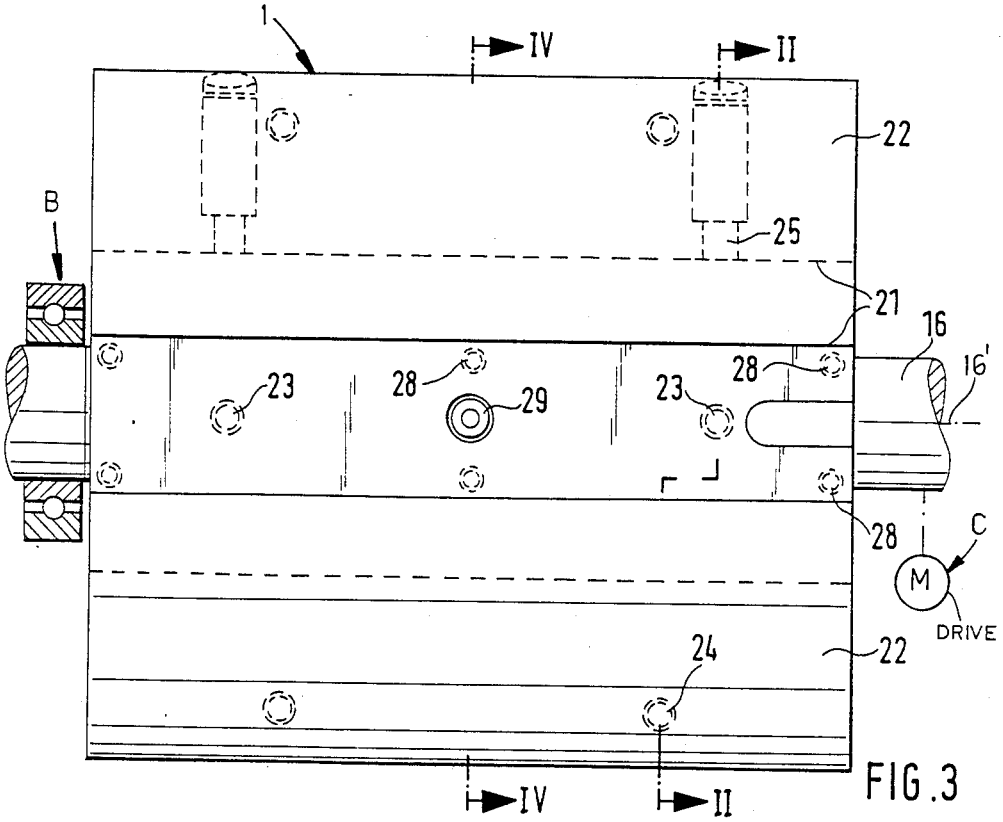
FIG. 3 is a top plan view of the applicator cylinder of FIG. 2.
Figure 4:
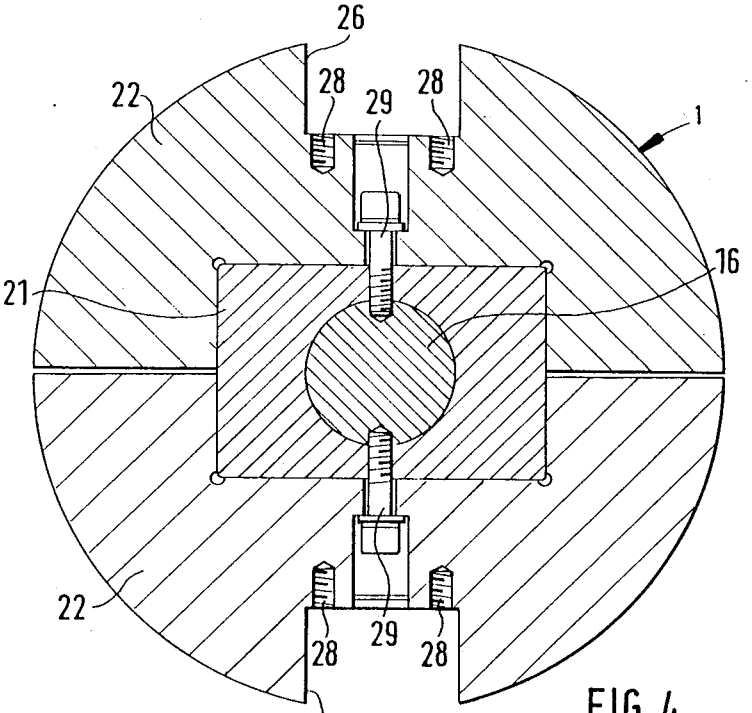
FIG. 4 is a cross sectional view through the applicator cylinder taken along the section lie IV—IV of FIG. 3.

Because of the high rotational speeds reached with the applicator cylinder 1 of the embodiment of FIGS. 2 to 4 a special screw coupling is chosen which makes the mounting and demounting of the applicator cylinder 1 easier. The radial screw coupling 23 according to FIG. 2 clamps both cylinder bodies 22 against each other and allows these to contact and be mounted on the longer sides of the rectangular cross sectioned central body 21. As shown in FIG. 3 two such radial screw couplings 23 are provided on both ends of the applicator cylinder 1. In the center of the applicator cylinder 1 longitudinally there is one mounting coupling 29 shown in cross section in FIG. 4 which has the purpose of retaining one of the individual cylinder half shells 22 on the central body 21, while the other cylinder body 22 after loosening the screw coupling 23 and the other mounting coupling 29 can be lifted from the central body 21.

Thus when the screw and mounting couplings are in place a practically inseparable mounting uninfluenced by centrifugal force of the cylinder half shells 22 on the central body 21 exists when the cylinder half shells 22 are additionally attached by the peripheral screw couplings 24 and by the radial screw couplings 23 with the central body 21.

In the example shown in FIGS. 2 and 5 the curved outer surface 34 of the insert 7 can have a larger curvature than the outer surface of the applicator cylinder 1 so that it is guaranteed that the region around the outlet openings 8 is tangent to the imaginary extension of a line 8*a* on the outer surface of the applicator cylinder. In this way it is possible to use one and the same insert 7 for applicator cylinders which are of different diameters. On mounting the insert 7 in the guide 26 surface discontinuities or staggered portions 27 result which as long as they are not too large do not damage the web 6 guided on the applicator cylinder 1.

These surface discontinuities 27 in the surface of the cylinder 1 may be reduced when according to the embodiment of FIG. 5 the curved outer surface of the insert 7 is provided with step like recesses 33 in which filler members 35 are mounted. These filler members 35 have a curved outer surface 37[1], which completely corresponds to the curvature of the applicator cylinder 1. Consequently the surface discontinuities 36 is substantially reduced compared to the surface discontinuities 27 in FIG. 2.

FIG. 5 shows also the position of the outlet openings 8 in comparison to the adhesive material feed duct 30 which is substantially closed by a control shaft 32 whose diameter is slightly less than that of the adhesive material feed duct 30. In the remaining gap a closing member 31 attached to the control shaft 32 moves, which covers the inner side of the the outlet opening 8 and thus the adhesive material which is in the gap between the duct wall and the control shaft 32 is prevented from flowing through the outlet opening 8.

Figure 6:
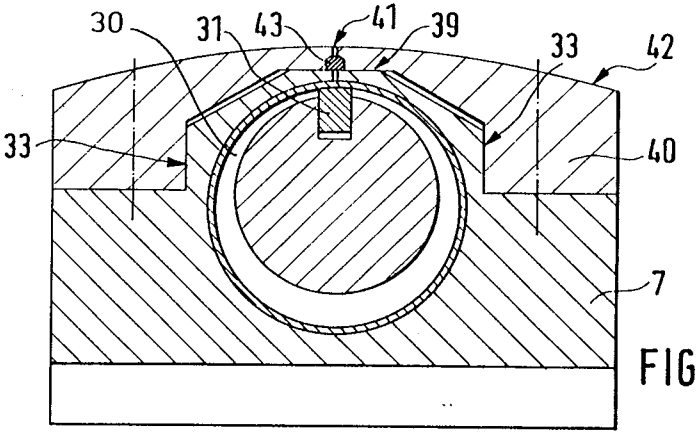
FIG. 6 is a cross sectional view through an insert with a covering member.

A still simpler possibility for accomplishing the transverse adhesive application with different diameter applicator cylinders is apparent from FIG. 6. The insert 7 has likewise steps 33 but instead of the filler members 35 of FIG. 5 a covering member 40 covering the entire insert 7 is used. This covering member 40 has the same curvature as the applicator cylinder 1 on its outer surface. Should the diameter of the applicator cylinder change, then only the fitting covering member 40 need be changed while the insert 7 remains unchanged. The insert 7 has a rear set back contacting surface 39 which contains the outlet openings 8 and against which the covering member 40 is clamped. The continuations 41 of the outlet openings 8 is located in it.

The closing member 31 is set back a distance corresponding to the wall thickness of the insert 7 and the covering member 40 which does not cause a disadvantage in application of the adhesive material.

The continuations 41 of the outlet openings 8 can the be widened inside and thus space for the stopper 43 is provided with whose help the application of the adhesive, particularly its width, can be altered according to operator choice since where there is a stopper no adhesive can be applied.

This allows varying adhesive application operations to be practiced.

I claim:

1. In an apparatus for application of an adhesive material to a web in contact with a substantial region of the outer surface of an applicator cylinder driven rotatably about a rotation axis thereof and in which said adhesive material is conducted from a fixed axial passage to an adhesive material feed duct rotating with said applicator cylinder which extends to a line on said outer surface of said applicator cylinder on which a plurality of outlet openings for said adhesive material are provided, the improvement wherein said applicator cylinder is subdivided into;

a shaft having a drive and bearings;

more than one interchangeable cylinder body of a selectable diameter forming the outer circumference of said applicator cylinder, said bodies being formed with at least one guide;

an insert in said guide which has said adhesive material feed duct of said outlet openings therein, and means for affixing said bodies nonrotatably to said shaft so as to allow them to be interchanged with other bodies of different dimensions determining the diameter of said cylinder; and wherein two of said cylinder bodies are attached to a central body rigidly attached to said shaft, said central body having a prismatic, particularly rectangular, cross-section, and said cylinder bodies forming said outer circumference of said applicator cylinder are screwed on said central body from different directions;

each of said cylinder bodies forming said outer circumference of said applicator cylinder being a cylinder half shell with a prismatic central interior for engaging said central body and at least one of said cylinder half shells having at least one of said guides for receiving said insert;

both of said cylinder half shells being clamped against each other by screws penetrating said shaft and said central body, and being screwed directly together peripherally and at a right angle to said central body.

2. The improvement according to claim 1 wherein said adhesive material feed duct present in said insert is connected to said axial supply duct in said shaft by a connecting tube extending along the front surface of said applicator cylinder.

3. The improvement according to claim 1 wherein said insert is provided for use in any of a plurality of said applicator cylinders having different sized diameters, the curvature of the outer surface of said insert corresponding to the curvature of said outer surface of the smallest of said applicator cylinders.

4. The improvement according to claim 3 wherein said outer surface of said insert has a step at two sides thereof and in each of the steps so formed a filler member is inserted, which has said curvature matching the curvature of said outer surface of said applicator cylinder.

5. The improvement according to claim 1 wherein said insert containing said adhesive material feed duct has a rear set back contacting surface having said outlet holes therein against which a covering member covering said insert is clamped whose outer surface has a curvature corresponding to the curvature of said applicator cylinder and a continuation of each of said outlet openings of said insert extends to said outer surface of said covering member.

6. The improvement according to claim 5 wherein each of said continuations of said outlet openings has a larger diameter on the inner side of said covering member than on the exterior side thereof and is dimensioned to receive a stopper for each of said closing each of said continuations of said outlet openings.

7. The improvement according to claim 1 wherein for sealing said outlet openings when said applicator cylinder is at rest at least one sealing roller mounted on an upright leg of a movable bent lever is provided which is said sealing roller having means to seal said outlet openings in different sized ones of said applicator cylinders.

8. The improvement according to claim 7 wherein when two of said inserts are provided in each of said applicator cylinders two of said movable bent levers are provided each having said sealing rollers for closing said outlet openings of said inserts and said bent levers are connected to a common drive mechanism between said bent levers.

9. An apparatus for application of an adhesive material to a web in transverse adhesive material portions spaced from each other on said web comprising a shaft for an applicator cylinder rotatably mounted in an operating machine with a drive for rotating said shaft and bearings for said shaft;

more than one cylinder body attached rigidly on said shaft interchangeable with any of a plurality of different size ones of said cylinder bodies which forms the outer circumference of said applicator cylinder;

at least one guide in said cylinder body accessible from said outer circumference;

an insert fitting into and mountable in each of said guides of said cylinder body;

an adhesive material feed duct in said insert connected to a row of outlet holes in the outer surface of said insert of said cylinder body, said adhesive material feed duct being connectable to an axial supply tube for said adhesive material; at least one sealing roller mounted on a bent lever pivotable so that said sealing roller can close said outlet holes when said applicator cylinder is at rest; and wherein two of said cylinder bodies are used and each of said cylinder bodies is a cylinder half shell detachably but rigidly mountable on a prismatic cross section central body which is attached to said shaft.

* * * * *